US007210500B2

(12) United States Patent
Achmad et al.

(10) Patent No.: US 7,210,500 B2
(45) Date of Patent: May 1, 2007

(54) METHODS AND APPARATUS FOR MECHANICALLY ADJUSTING A NULL OFFSET IN A TORQUE MOTOR OF A SERVOVALVE

(75) Inventors: Muchlis Achmad, Santa Clarita, CA (US); Bernard Johnson, Santa Paula, CA (US)

(73) Assignee: HR Textron, Inc., Santa Clarita, CA (US)

( * ) Notice: Subject to any disclaimer, the term of this patent is extended or adjusted under 35 U.S.C. 154(b) by 156 days.

(21) Appl. No.: 10/975,748

(22) Filed: Oct. 28, 2004

(65) Prior Publication Data

US 2006/0090799 A1 May 4, 2006

(51) Int. Cl.
*F15B 13/043* (2006.01)

(52) U.S. Cl. ..... 137/625.62; 137/315.41; 137/15.17; 137/315.16; 73/1.72; 73/1.25

(58) Field of Classification Search ..... 137/625.62, 137/625.61, 315.41, 15.17, 15.21, 315.09, 137/315.16; 73/1.25, 1.68, 1.72
See application file for complete search history.

(56) References Cited

U.S. PATENT DOCUMENTS 3,058,038 A * 10/1962 Stedman, Jr. et al. ..... 335/229

(Continued)

FOREIGN PATENT DOCUMENTS

EP 00124335 1/1988
GB 1147204 4/1969
GB 1229616 4/1971
GB 1260438 1/1972

(Continued)

OTHER PUBLICATIONS (Abstract) Lee, S.R.; Srinivasan, K. "Self-tuning control application to closed-loop servohydraulic material testing", Dec. 1990, vol. 112, No. 4, pp. 680-689.

(Article) Saikat Mookherjee, "Design and sensitivity analysis of a single-stage electro-hydraulic servovalve", Proc. Of 1st FPNI-PhD Symp. Hamburg 2000, pp. 71-88.

Jack L. Johnson, P.E. "Understanding Valve Specifications" Motion System-Hydraulics & Pneumatics, Penton Media, vol. 57, No. 12, Dec. 2004, pp. 24-27.

"International Search Report for Application No. PCT/US 2005/038763 mailed Mar. 15, 2006", Mar. 7, 2006, 5 pages.

*Primary Examiner*—Eric Keasel
*Assistant Examiner*—Craig Schneider
(74) *Attorney, Agent, or Firm*—Bainwood Huang

(57) ABSTRACT

A servovalve assembly includes a motor having a flapper shaft. A flapper couples to a first end of the flapper shaft such that the flapper shaft orients the flapper between a first nozzle and a second nozzle of the servovalve assembly. An adjustment assembly adjusts a position of the flapper relative to the nozzles of the servovalve. The adjustment assembly enables a servovalve manufacturer to set the flapper of the servovalve at a null position without disassembling the servovalve. Rather, the manufacturer is capable of simply installing the adjustment assembly and deforming an arm portion of the adjustment assembly for proper null position calibration.

6 Claims, 6 Drawing Sheets

U.S. PATENT DOCUMENTS

| | | | | | |
|---|---|---|---|---|---|
| 3,587,016 | A | | 6/1971 | Coakley | 335/237 |
| 3,635,156 | A | * | 1/1972 | Krebs et al. | 101/93.33 |
| 3,772,964 | A | | 11/1973 | Erickson et al. | 91/411 |
| 3,777,784 | A | * | 12/1973 | Nicholson | 137/625.62 |
| 3,974,715 | A | | 8/1976 | Habiger | 74/570.21 |
| 4,282,502 | A | * | 8/1981 | Nicholson | 335/266 |
| 4,362,182 | A | | 12/1982 | Sjolund | 137/85 |
| 4,507,634 | A | | 3/1985 | Vanderlaan | 335/272 |
| 4,576,198 | A | | 3/1986 | Coakley et al. | 137/596 |
| 4,793,377 | A | * | 12/1988 | Haynes et al. | 137/625.65 |
| 5,327,061 | A | | 7/1994 | Gullapalli | 318/649 |
| 5,337,262 | A | | 8/1994 | Luthi et al. | 702/83 |
| 5,722,460 | A | | 3/1998 | Olsen et al. | 137/625.65 |

FOREIGN PATENT DOCUMENTS

| | | | | |
|---|---|---|---|---|
| GB | 1317967 | | 5/1973 | |
| GB | 2123185 | A | 1/1984 | 3/14 |
| GB | 2176314 | | 12/1986 | |
| GB | 2176314 | A | 12/1986 | 9/7 |

* cited by examiner

METHODS AND APPARATUS FOR MECHANICALLY ADJUSTING A NULL OFFSET IN A TORQUE MOTOR OF A SERVOVALVE

BACKGROUND

In general, servovalves convert relatively low power electrical control input signals into a relatively large mechanical power output. FIG. 1 illustrates a conventional nozzle-flapper servovalve 10, such as a nozzle-flapper servovalve. The nozzle-flapper servovalve 10, for example, includes a housing 12 having a motor 14, a control shaft 16, an armature 17, a first nozzle 18, and a second nozzle 20. The control shaft 16 includes a flapper 22 oriented between the first nozzle 18 and the second nozzle 20 such that the flapper 22 defines a first gap 24 with the first nozzle 18 and defines a second gap 26 with the second nozzle 20. The nozzle-flapper servovalve 10 also includes a sleeve 28, a spool 30 disposed within the sleeve 28, and a feedback spring 32 coupling the armature 17 of the motor 14 to the spool 30.

During operation, when the motor 14 receives an input signal, such as from a controller, the motor 14 causes the spool 30 to meter fluid flow between a pressurized fluid source 34 and a hydraulic or fluid motor 36 coupled to the servovalve 10. In response to receiving a control signal, the motor 14 positions the armature 17 such that the armature 17 rotates the control shaft 16 and the flapper 22 causing the flapper 22 to impinge either the first nozzle 18 or the second nozzle 20. By impinging either the first nozzle 18 or the second nozzle 20, the flapper 22 causes an increase in fluid pressure (i.e. from a pressurized fluid source 35 via fixed orifices 37) in either a first chamber 38 or a second chamber 40, respectively, as defined by the housing 12 and the sleeve 28 and oriented at opposing ends 42, 44 of the spool 30.

In response to the increase in pressure, the spool 30 translates within the sleeve 28 to an open position. In the open position, lands 46-1, 46-2 of the spool 30 position relative to openings 48-1, 48-2 defined by the sleeve 28 to meter an amount of fluid flowing between the fluid source 34 and the fluid motor 36 to control positioning or movement of a load coupled to the fluid motor 36. As the spool 30 moves in response to the input signal, the spool 30 generates an opposing torque on the feedback spring 32. The torque on the feedback spring 32 repositions the flapper 22 to a substantially centered position relative to the nozzles 18, 20 and creates a force balance across the spool 30, thereby bringing the spool 30 to an equilibrium position.

As shown in FIG. 1, when the spool 30 positions in a null or closed position within the sleeve 28, such as in response to receiving a zero current control signal from a controller, each set of lands 46-1, 46-2 cover associated openings or ports 48-1, 48-2 oriented between the fluid source 34 and the fluid motor 36. In the null position, each set of lands 46-1, 46-2 minimizes fluid flow between the fluid source 34 and the fluid motor 36 via the ports 48-1, 48-2 to maintain a pressure gain within the servovalve assembly 10.

The position of the flapper 22, relative to the nozzles 18, 20, affects the pressure output of the servovalve 10. For example, assume the spool 30 orients in the null position within the servovalve 10 such that the servovalve produces a predetermined pressure output. Additionally, assume the flapper 22 also orients in a null position between the first nozzle 18 and the second nozzle 20 such that the first gap 24 (e.g., defined as the space between the flapper 22 and the first nozzle 18) is equal to the second gap 26 (e.g., defined as the space between the flapper 22 and the second nozzle 20). With such positioning of the flapper 22, the flapper 22 maintains equilibrium pressure within the first chamber 38 and the second chamber 40 of the servovalve 10, thereby maintaining the null position of the spool 30 within the servovalve 10 and maintaining the pressure output of the servovalve 10.

During the manufacturing process, however, due to manufacturing imprecision and tolerance stack-up errors, the manufacturer typically cannot position the flapper 22 in exactly the null position relative to the first nozzle 18 and the second nozzle 20. As such, the inexact positioning of the flapper 22 relative to the first nozzle 18 and the second nozzle 20 adjusts the pressures within the chambers 38, 40 (e.g., such that the pressure in the first chamber 38 is not substantially equal to the pressure in the second chamber 40), thereby affecting the pressure output of the servovalve 10. Prior to shipping the completed servovalve 10, therefore, the manufacturer measures the pressure output of the servovalve 10 to detect the positioning of the flapper 22 relative to the nozzles 18, 20.

Conventionally, during the testing procedure, the manufacturer disassembles a portion of the servovalve 10 and, using a test station, measures the pressure output of the servovalve 10. The partial disassembly provides the manufacturer with access to the flapper 22 and nozzles 18, 20 to allow repositioning of the nozzles 18, 20, based upon the measured pressure output. In the case where the test station indicates that the servovalve 10 does not produce a pressure output in accordance with specifications of the servovalve 10, the manufacturer physically repositions the nozzles 18, 20 within the servovalve 10, relative to the flapper 22. With the servovalve 10 connected to the test station, the manufacturer, using specialized tools, iteratively repositions the nozzles 18, 20 relative to the flapper 22 until the first gap 24 substantially equals the second gap 26 and the servovalve produces a pressure output in accordance with specifications of the servovalve 10. Such repositioning of the nozzles 18, 20 overcomes manufacturing imprecision and stack-up errors and allows positioning of the flapper 22 in a null position relative to the nozzles 18, 20.

SUMMARY

Conventional null offset adjustment techniques for the flapper of a nozzle-flapper servovalve, however, suffers from a variety of deficiencies.

As indicated above, to detect the positioning of the flapper 22 relative to the nozzles 18, 20, the manufacturer disassembles the servovalve 10 in part and, using a test station, measures the pressure output of the servovalve 10. The partial disassembly provides the manufacturer with access to the flapper 22 and nozzles 18, 20 to allow repositioning of the nozzles 18, 20, based upon the measured pressure output of the servovalve 10. Disassembly of the servovalve, however, is time consuming to the manufacturer and adds to the manufacturing cost of the servovalve 10.

Also as indicated above, when the manufacturer detects that the servovalve 10 does not produce a pressure output in accordance with specifications of the servovalve 10 the manufacturer physically repositions the nozzles 18, 20 within the servovalve 10, relative to the flapper 22. During the servovalve manufacturing process, the manufacturer typically shrink fits the nozzles 18, 20 to the housing of the servovalve 10. Adjustment of the positioning of the nozzles 18, 20 relative to the flapper 22, in order to produce a particular pressure output for the servovalve 10, requires specialized tools and skilled tool operators. The process of iteratively positioning of the nozzles 18, 20 relative to the flapper 22, using the tools, is time consuming to the manufacturer and adds to the manufacturing cost of the servovalve 10. Additionally, maintenance of the specialized tools, along with the training of the tool operators, also adds to the manufacturing cost of the servovalve 10.

By contrast, embodiments of the present invention significantly overcome the described deficiencies and provide techniques for adjusting a null offset position of a flapper of a nozzle-flapper servovalve using an adjustment device. The adjustment device includes an arm portion that operates to bias or adjust the position of the flapper relative to nozzles of the servovalve. Such a device enables a servovalve manufacturer to set the flapper of the servovalve at a null position without disassembling the servovalve. Rather, the manufacturer is capable of simply installing the device and deforming the arm portion of the device for proper null position calibration.

In one arrangement, an adjustment assembly includes a base configured to couple to a servovalve housing of a servovalve, a control portion configured to couple to an armature of a motor of the servovalve, and an arm portion that couples the base to the control portion. The arm portion is configured to, in response to a deformation of the arm portion, position the control portion relative to the base. In response to the deformation of the arm portion, the control portion is configured to position a flapper of the armature relative to a first nozzle and a second nozzle of the servovalve. The adjustment assembly enables a servovalve manufacturer to set the flapper of the servovalve at a null position (i.e. to adjust a pressure output of the servovalve) without disassembling the servovalve.

In one arrangement, the arm portion includes a spring wire that couples the base to the control portion. The spring wire is configured to, in response to a deformation, position the control portion relative to the base to generate a spring force on the armature and position the flapper relative to the first nozzle and the second nozzle. As such, once a user applies a deformation to the arm portion resulting in a bending force on the spring wire, when the flapper orients within a null position, the flapper maintains a substantially consistent orientation relative to the first nozzle and second nozzle over time, thereby maintaining a particular pressure output of the servovalve assembly over time.

In one arrangement, the control portion rotatably couples to the armature. In such an arrangement, when a user applies a deformation to the arm portion, rotation of the control portion relative to the armature minimizes application of a bending or shear stress, as generated by the armature, on an interface between the control portion and the spring wire. Rotatable coupling of the control portion relative to the armature minimizes failure of the adjustment assembly.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Embodiments of the present invention provide techniques for adjusting a null offset position of a flapper of a nozzle-flapper servovalve using an adjustment device or adjustment assembly. The adjustment device includes an arm portion that operates to bias the position of the flapper relative to nozzles of the servovalve. Such a device enables a servovalve manufacturer to set the flapper of the servovalve at a null position without disassembling the servovalve. Rather, the manufacturer is capable of simply installing the device and deforming the arm portion of the device for proper null position calibration.

Figure 1:
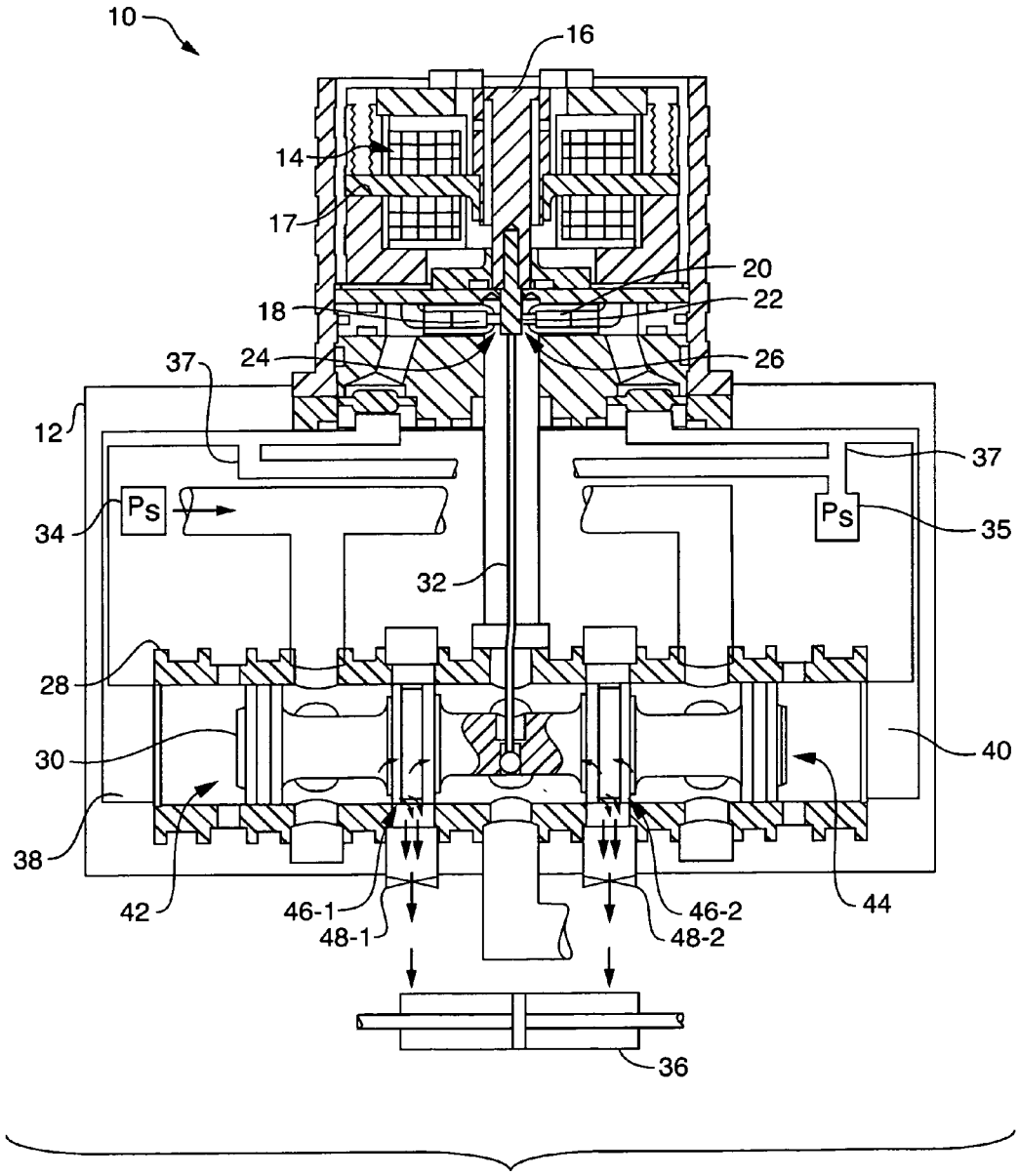
FIG. 1 (PRIOR ART)
FIG. 1 is a schematic view of a prior art servovalve assembly.
Figure 2:
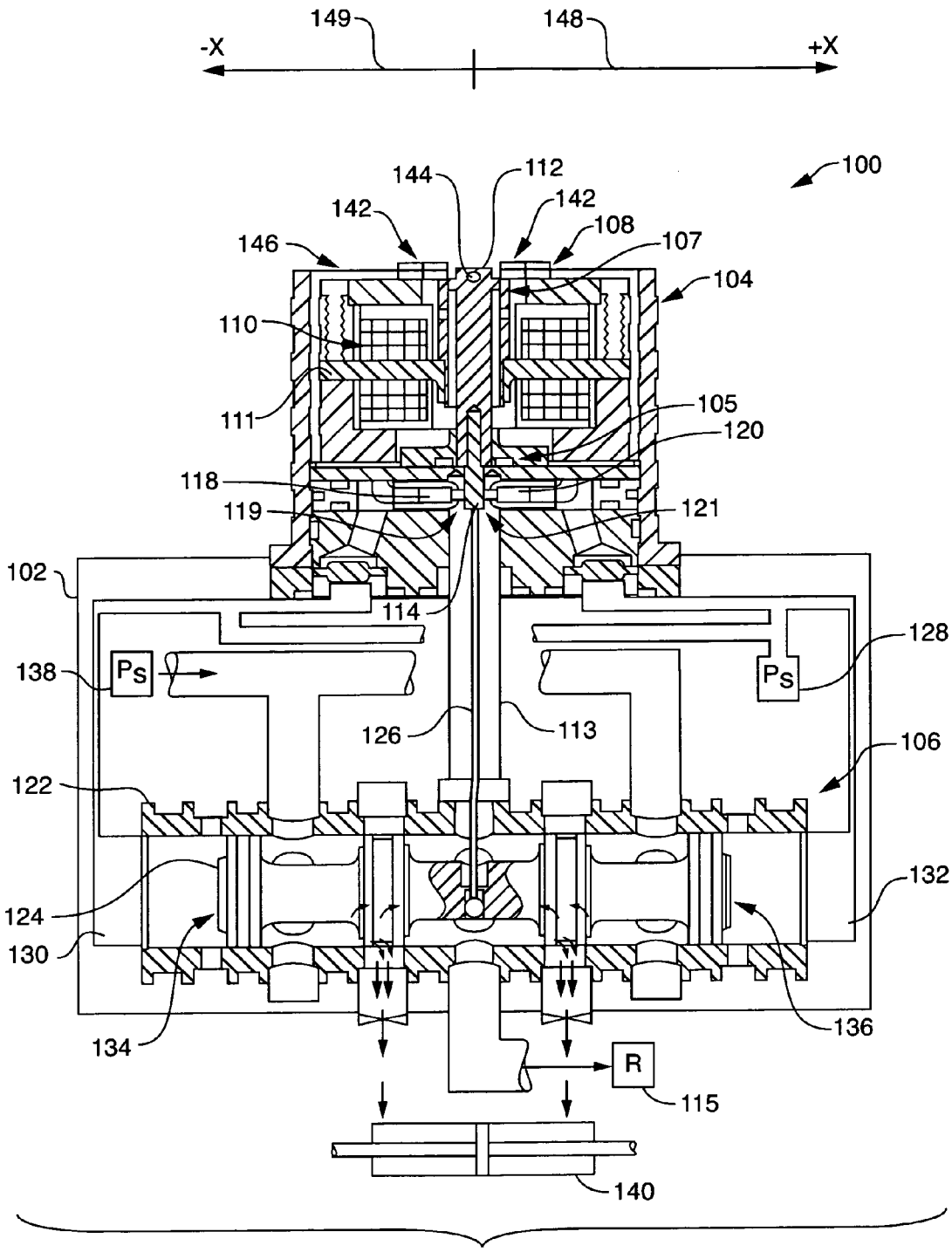
FIG. 2 illustrates a servovalve assembly having an adjustment assembly, according to one embodiment of the invention.

FIG. 2 illustrates an example of a servovalve assembly 100, such as a nozzle-flapper servovalve, having a housing 102 that includes a servovalve motor assembly 104, a sleeve assembly 106, and an adjustment assembly 108.

The servovalve motor assembly 104 includes a motor 110 having an armature 111, a shaft 112 (e.g., a flapper shaft), and a flapper 114 coupled to (i.e. integrally formed with) a first end 105 of the shaft 112. The flapper 114 orients relative to a first nozzle 118 and a second nozzle 120 of the servovalve 100 and defines a first gap or space 119 with the first nozzle 118 and a second gap or space 121 with the second nozzle 120. The nozzles 118, 120 are configured to deliver a fluid from a pressurized source 128 to the flapper 114. The flapper 114 directs the fluid from the first nozzle 118 and the second nozzle 120 to a channel 113 connected to a reservoir 115 to maintain a pressure output of the servovalve assembly 100.

The sleeve assembly 106 includes a sleeve 122, a spool 124 disposed within the sleeve 122, and a feedback spring 126 coupling the shaft 112 of the motor assembly 104 to the spool 124. The sleeve assembly 106 orients in fluid communication with the nozzles 118, 120 and the flapper 114 of the motor assembly 104.

During operation, for example, in response to receiving a control signal, the motor 110 positions the armature 111 rotates the shaft 112 and the flapper 114 causing the flapper 114 to impinge either the first nozzle 118 or the second nozzle 120. By impinging either the first nozzle 118 or the second nozzle 120, the flapper 114 causes an increase in fluid pressure (e.g., from a pressurized fluid source 128) in either a first chamber 130 or a second chamber 132, respectively, as defined by the housing 102 and the sleeve 122 and oriented at opposing ends 134, 136 of the spool 124. The increase in fluid pressure causes the spool 124 to translate within the sleeve 122 and meter an amount of fluid flowing between a pressurized fluid source 138 and a fluid motor 140, thereby controlling positioning or movement of a load coupled to the fluid motor 140. As the spool 124 moves in response to the control signal, the spool 124 generates an opposing torque on the feedback spring 126. The torque on the feedback spring 126 repositions the flapper 114 to a substantially centered position relative to the nozzles 118, 120 and creates a force balance across the spool 124, thereby bringing the spool 124 to an equilibrium position The adjustment assembly 108 couples to the housing 102 of the servovalve assembly 100 and to a second end 107 of the armature 112 of the motor assembly 104. As illustrated in FIG. 2, the adjustment assembly 108 mounts to an upper or top portion 146 of the housing 102 of the servovalve assembly 100 (i.e. the top portion 146 opposing the sleeve assembly 106 of the servovalve assembly 100). Such an orientation of the adjustment assembly 108 provides a user with minimally obstructed access to the adjustment assembly 108 during operation.

The adjustment assembly 108 is configured to generate a force or load on the shaft 112 to position or bias the flapper 114 (i.e. adjust lateral positioning of the flapper 114 along an +X axis 148 or a −X axis 149) within the first gap 119 and a second gap 121 relative to the respective nozzles 118, 120. Such positioning adjusts a positioning (i.e. a null positioning) or orientation of the flapper 114 relative to the first nozzle 118 and the second nozzle 120 to adjust a pressure output of the servovalve assembly 100. When oriented in the null position, the gap 119 defined between the first nozzle 118 and the flapper 114 is substantially equal to the gap 121 defined between the flapper 114 and the second nozzle 120.

As indicated above, the position of the flapper 114, relative to the nozzles 118, 120, affects the pressure output of the servovalve 100. For example, the spool 124 orients in a null position within the sleeve 122 in response to the servovalve 100 receiving a zero current control signal from a controller. In such an orientation of the spool 124, in order to maintain a particular pressure output of the servovalve assembly 100, the flapper 114 must orient in a substantially null position relative to the first nozzle 118 and the second nozzle 120 (i.e. to maintain equilibrium pressure within the first chamber 130 and the second chamber 132). However, tolerance stack-up and manufacturing imprecision limit the ability for the manufacturer to orient the flapper 114 in a substantially null position during manufacturing.

In order to overcome manufacturing imprecision and tolerance stack-up errors generated during manufacture of the servovalve assembly 100 (i.e. that cause inexact positioning of the flapper 114 relative to the first nozzle 118 and the second nozzle 120), the adjustment assembly 108 allows a user to position the flapper 114 relative to the nozzles 118, 120 such that the flapper 114 orients in a substantially null position relative to the nozzles 118, 120. The adjustment assembly 108 allows positioning of the flapper 114 relative to the nozzles 118, 120, rather than the conventional positioning of the nozzles relative to the flapper. The adjustment assembly 108, therefore, enables a servovalve manufacturer to set the flapper of the servovalve at a null position (e.g., position the flapper 114 relative to the nozzles 118, 120) without disassembling the servovalve assembly 100. Additionally, the adjustment assembly 108 limits the necessity for the manufacturer to procure and maintain specialized tools conventionally used in repositioning the shrink-fit nozzles 118, 120 within the housing 102.

As indicated above, the adjustment assembly 108 mounts to the upper portion 146 of the housing 102 of the servovalve assembly 100. Such an orientation of the adjustment assembly 108 provides a user with substantially unobstructed access to the adjustment assembly 108 and indirect access to the flapper 114 when adjusting the relative position of the flapper 114 relative to the nozzles 118, 120. The orientation of the adjustment assembly 108, relative to the housing 102 of the servovalve assembly 100 and relative to the flapper 114, also minimizes the need for the manufacturer to disassemble the servovalve assembly 100 and the motor assembly 104 to adjust the position of the flapper 114 relative to the first nozzle 118 and the second nozzle 120. As such, use of the adjustment assembly 108 reduces manufacturing time and costs related to the servovalve assembly 100.

Figure 3:
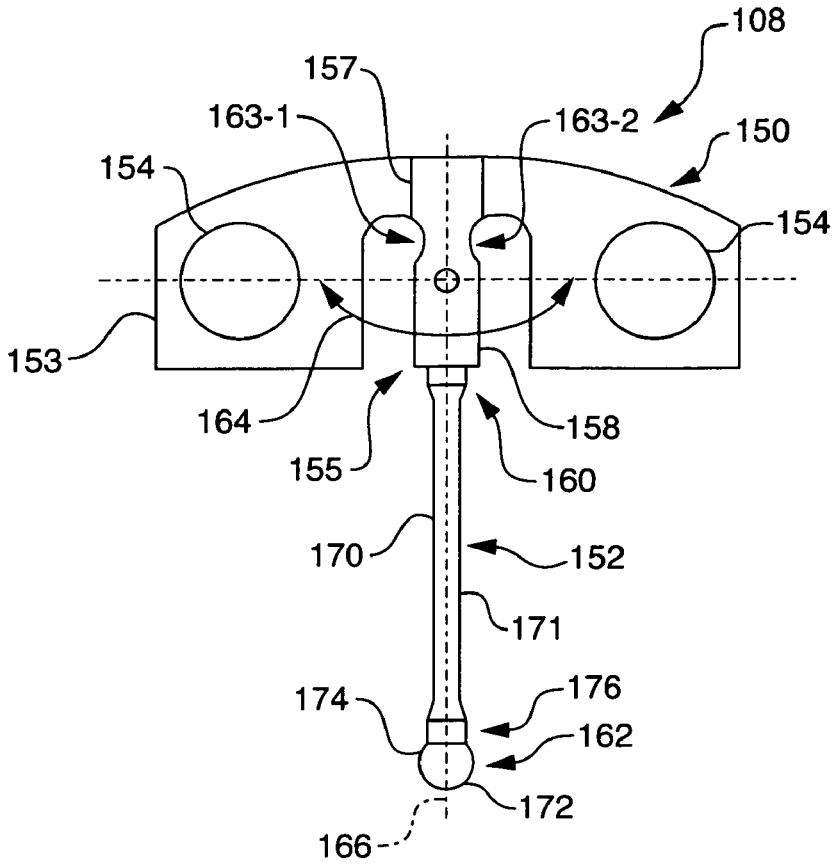
FIG. 3 illustrates a top view of the adjustment assembly of FIG. 2, according to one embodiment of the invention.
Figure 4:
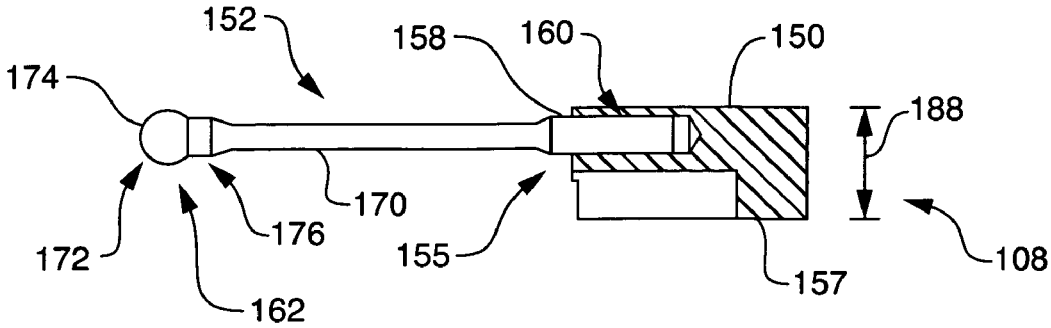
FIG. 4 illustrates a side view of the adjustment assembly of FIG. 2, according to one embodiment of the invention.

FIGS. 3 and 4 illustrate details of an arrangement of the adjustment assembly 108. The adjustment assembly 108 includes a base 150, an arm portion 152, and a control portion 172. The base 150 attaches to the housing 102 of the servovalve assembly 100 and the control portion 172 attaches to the shaft 112 of the servovalve motor 104. The arm portion or adjustment assembly 152 couples the base 150 to the control portion 172.

As will be described below, the adjustment assembly 108 allows positioning of the control portion 172 relative to the base 150, such as in response to a deformation of the holder 155, relative to the base 150. In response to deformation of the arm portion 152, the control portion 172 generates a load or force on the shaft 112 to adjust a lateral positioning (i.e. along the +X axis 148 or the −X axis 149) of the shaft 112 within the motor 110. Adjustment of the lateral positioning of the shaft 112 adjusts the position of the flapper 114 relative to the nozzles 118, 120 of the servovalve assembly 100 to obtain a null positioning of the flapper 114 relative to the nozzles 118, 120, thereby adjusting a pressure output of the servovalve assembly 100.

In one arrangement, the base 150 includes a servovalve attachment portion 153 and a holder 155. The servovalve attachment portion 153 defines openings 154 configured to receive fasteners 142, such as bolts as illustrated in FIG. 2, to secure the adjustment assembly 108 to the housing 102 of the servovalve assembly 100.

Returning to FIGS. 3 and 4, the holder 155 includes a base attachment portion 157 and an arm attachment portion 158. The base attachment portion 157, for example is integrally formed with the servovalve attachment portion 153. The arm attachment portion 158 couples to a first end 160 of the arm portion 152 by way of a brazing process, for example.

The holder 155, in one arrangement, defines cavities or fillets 163-1, 163-2 oriented at a location between the base attachment portion 157 and the arm attachment portion 158. The fillets 163-1, 163-2 are configured to minimize resistance of the holder 155 to bending forces 164 applied to the holder 155, relative to a long axis 166 of the adjustment assembly 108. In other words, the fillets 163-1, 163-2 allow rotation of the arm portion 152 relative to the base 150 while minimizing induction of fatigue or failure stresses within the holder 155 during operation.

In one arrangement, the arm portion 152 includes a spring wire 170. The spring wire 170, in one arrangement, is formed from a stainless steel material and generates a spring force on the shaft 112 in response to application of a deformation or a bending force 164. The spring force biases the shaft 112 within the motor 110, either along the +X axis 148 or the −X axis 149 to position the flapper 114 relative to the first nozzle 118 or the second nozzle 120 to adjust the pressure output of the servovalve assembly 100. The spring wire 170 maintains a substantially consistent force on the shaft 112 over time. As such, once a user applies a bending force 164 on the spring wire 170, the flapper 114 maintains a substantially consistent orientation relative to the first nozzle 118 and second nozzle 120 over time.

In one arrangement, the spring wire 170 includes a cold worked surface 171. Manufacturers typically cold work the surfaces of metal materials in order to improve fatigue-resistance characteristics of the materials. For example, in the process of peening, a manufacturer blasts a surface of a metal material with shot pellets in order to generate a compressive stress in the material below the surface of the material. When a manufacturer applies a load, such as a tensile load to the material, the compressive stress generated in the material during the peening process reduces a net stress in the material, as caused by the tensile loading of the material. Cold working or peening of the surface of the spring wire 170, therefore, increases the resistance of the spring wire 170 to fatigue stress and minimizes the potential for failure of the spring wire 170 during operation.

The control portion 172 couples to a second end 162 of the spring wire 170 (i.e. a second end 162 of the arm portion 152) by way of a brazing process, for example. The control portion 172, in one arrangement, rotatably couples to the shaft 112 thereby allowing rotation of the control portion 172 relative to the shaft 112 during operation. For example, during operation, a manufacturer applies a deformation to the holder 155 resulting in bending force to the spring wire 170. As the spring wire 170 bends in response to the deformation, the spring wire 170 causes the control portion 172 to apply a lateral force to the shaft 112. With the control portion 172 rotatably coupled to the shaft 112, as the spring wire 170 bends, such bending causes the control portion 172 to rotate relative to the shaft 112. In turn, rotation of the control portion 172 relative to the shaft 112 minimizes application of a bending or shear stress, as generated by the shaft 112, on an interface 176 between the control portion 172 and the spring wire 170. Rotation of the control portion 172 relative to the shaft 112 during operation, therefore, minimizes potential failure of adjustment assembly 108 during operation.

As shown in FIGS. 3 and 4, in one arrangement, a manufacturer forms the control portion 172 as a sphere or ball 174, such as from a tungsten carbide material. During assembly, the ball 174 inserts within an opening 144 defined by the shaft 112

Figure 5:
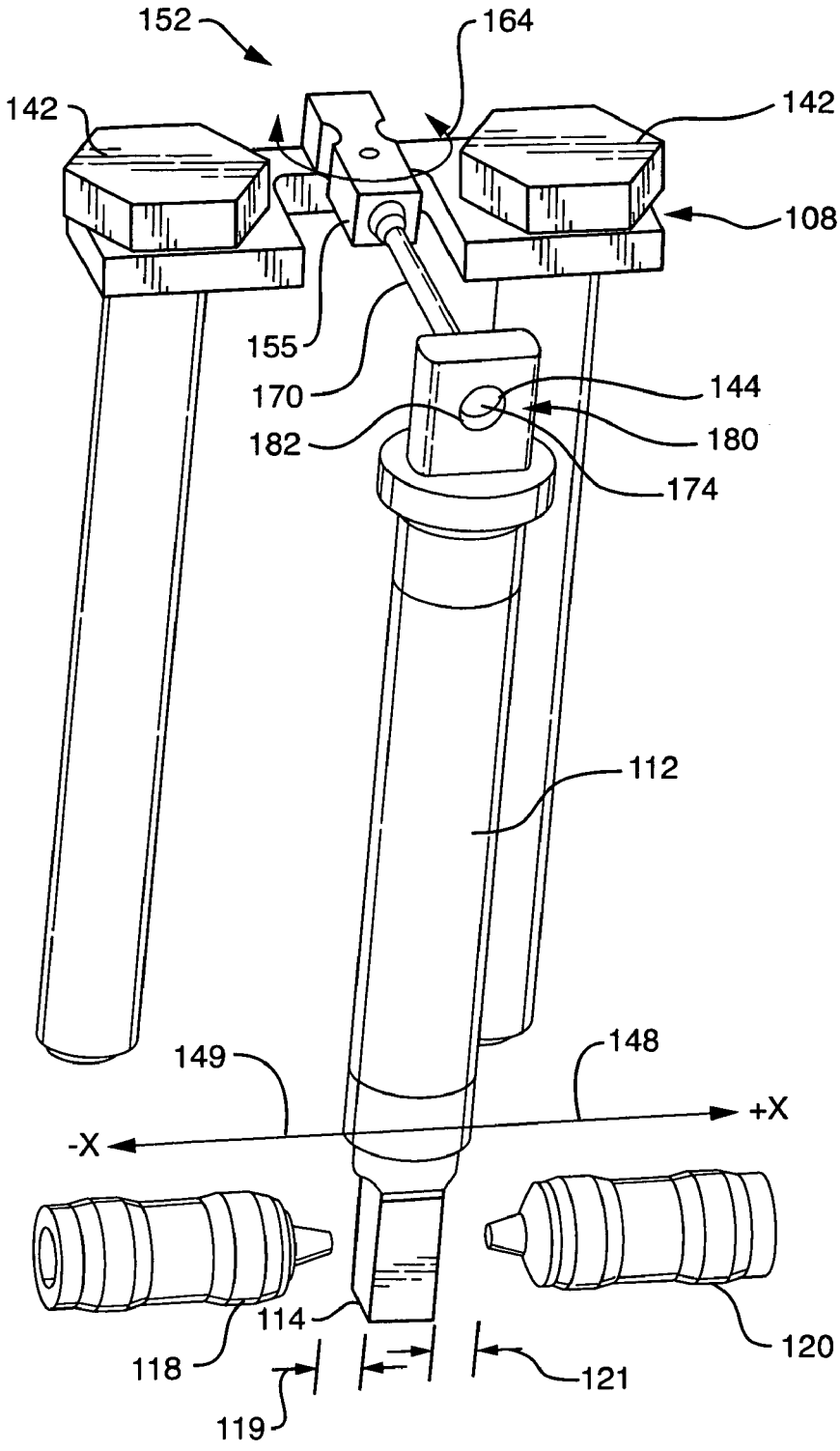
FIG. 5 illustrates a perspective view of the adjustment assembly coupled to an armature of a servovalve, according to one embodiment of the invention.

FIG. 5 illustrates coupling of the ball 174 to the shaft 112. As shown, the ball 174 inserts within the opening 144 defined by the shaft 112. In one arrangement, insertion of the ball 174 within the opening 144 forms a ball and socket joint or interface 180 between the ball 174 and wall 182 of the shaft 112 defined by the opening 144. The ball and socket joint 180 minimizes application of a bending stress, as generated by the shaft 112, on an interface 176 between the ball 174 and the spring wire 170.

For example, during operation, in response to application of a bending force 164 on the holder 155, the spring wire 170 bends (i.e. deflects relative to the base 150 and the shaft 112). As the spring wire 170 bends, the ball 174 rotates within the opening 144 of the shaft 112. As such, the ball 174 transmits a portion of the spring force from the spring wire 170 to the shaft 112 to position the flapper 114 either along the +X axis 148 or the −X axis 149 relative to the first nozzle 118 or the second nozzle 120. Additionally, rotation of the ball 174 relative to the opening 144 minimizes an amount of stress on an interface between ball 174 and spring wire 170 (i.e. the interface where the brazing process attaches the ball 174 to the spring wire 170). Rotation of the ball 174 within the opening 144 of the shaft 112 during operation, therefore, minimizes potential failure of adjustment assembly 108 during operation.

Figure 6:
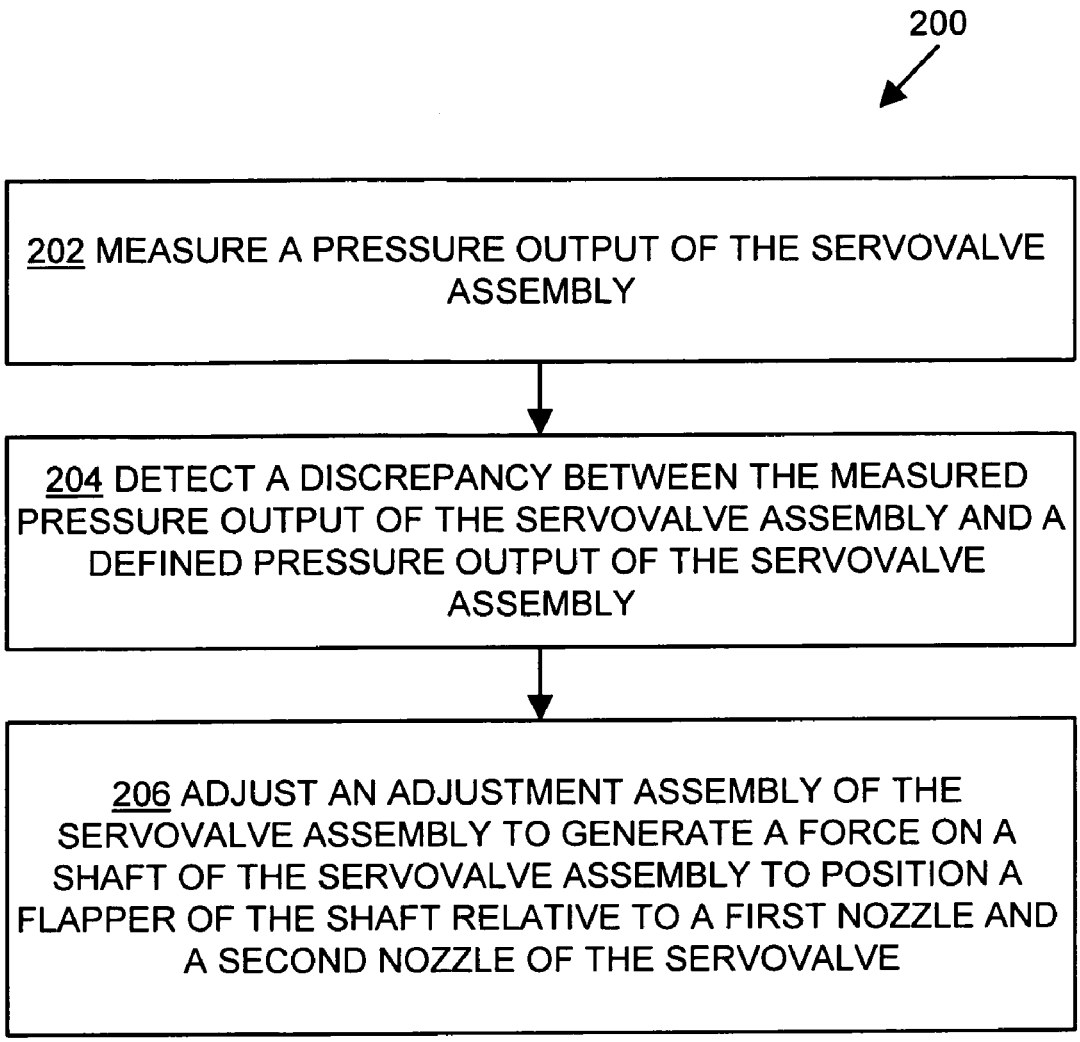
FIG. 6 is a flowchart of a procedure performed by a manufacturer when adjusting the position of a flapper of the servovalve assembly of FIG. 2, according to one embodiment of the invention.
Figure 7:
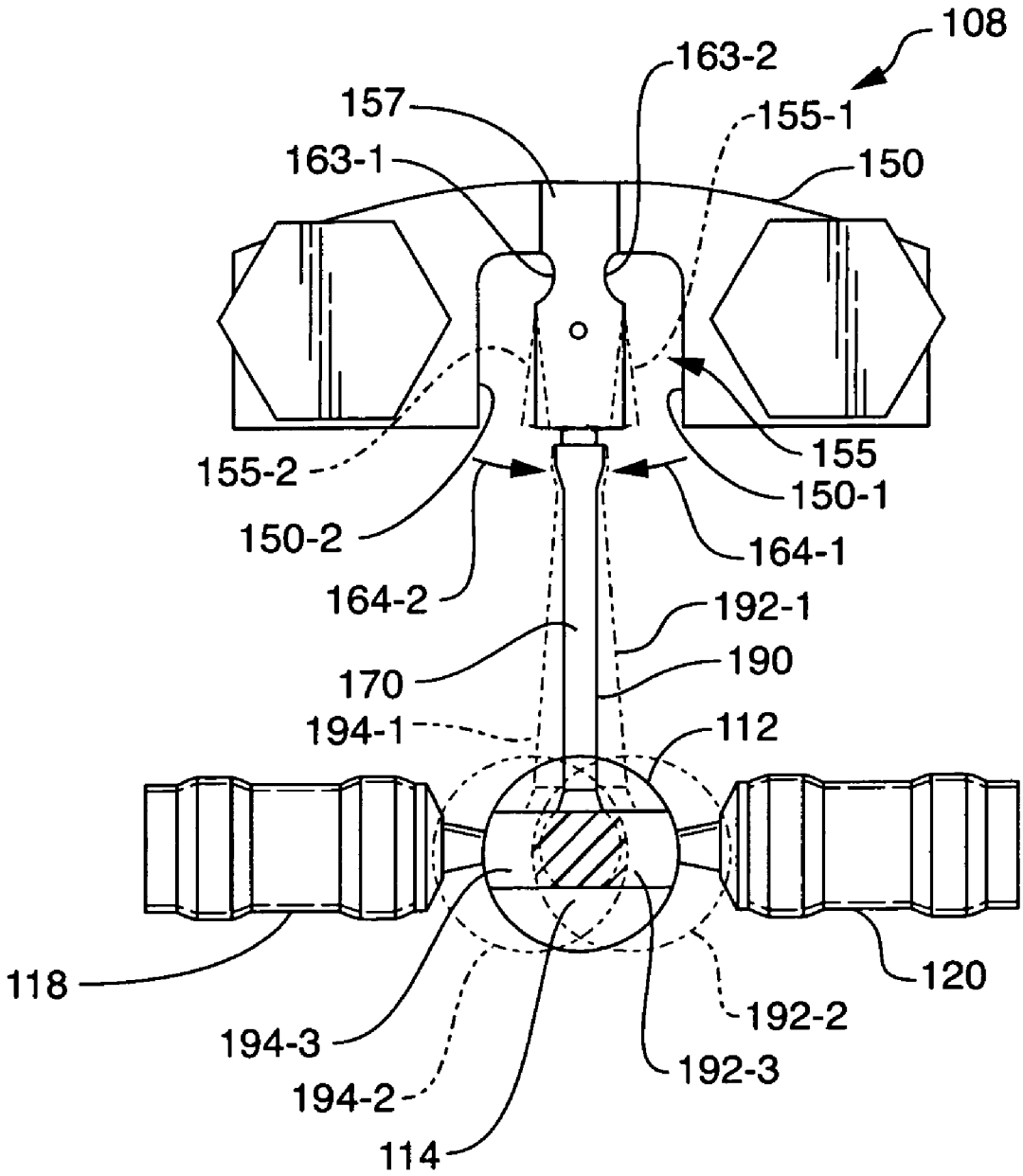
FIG. 7 illustrates a top view of the adjustment assembly and armature of FIG. 5, according to one embodiment of the invention.

As indicated above, a user utilizes the adjustment assembly 108 to minimize or remove the presence of tolerance stack-up errors and manufacturing inconsistencies with respect to the orientation of the flapper 114 relative to the first nozzle 118 and the second nozzle 120. For example, the adjustment assembly 108 allows a user to position the flapper 114 relative to the nozzles 118, 120 such that the flapper 114 orients in a substantially null position relative to the nozzles 118, 120. Such positioning allows the servovalve assembly 100 to produce and maintain a particular pressure output. FIGS. 6 and 7 relate to operation of the adjustment assembly 108 within the servovalve assembly 100.

FIG. 6 is a flowchart 200 of a procedure for positioning the flapper 114 within the servovalve assembly 100, such as to a null position relative to the first nozzle 118 and the second nozzle 120. The procedure can be performed manually by a manufacturer (i.e. a machine operator) or can be performed in an automated manner.

In step 202, the manufacturer measures a pressure output of the servovalve assembly 100. For example, after manufacturing the servovalve assembly 100, the manufacturer attaches the servovalve assembly 100 to a test assembly to detect a pressure output of the servovalve assembly 100.

In step 204, the manufacturer detects a discrepancy between the measured pressure output of the servovalve assembly 100 and a defined pressure output of the servovalve assembly 100. The defined pressure output relates to an optimal or expected pressure output of the servovalve assembly, in accordance with specifications of the servovalve assembly 100. Typically, the positioning of the flapper 114 relative to the nozzles 118, 120 (i.e. in a "non-null" position) causes a discrepancy between the measured pressure output and the defined pressure output.

For example, assume the spool 124 of the servovalve assembly 100 orients in a null position. In the case where the flapper 114 also orients in a null position relative to the first nozzle 118 and the second nozzle 120, the test assembly detects the measured pressure output as substantially equal to the defined pressure output from the servovalve assembly 100. As such the manufacturer does not detect a discrepancy between the defined pressure output and the measured pressure output of the servovalve assembly 100, thereby indicating proper positioning of the flapper 114 relative to the nozzles 118, 120. In the case where the flapper 114 fails to orient in a null position relative to the first nozzle 118 and the second nozzle 120, such as caused by tolerance stack-up during the servovalve manufacturing process, the test assembly detects the measured pressure output as being unequal to the defined pressure output of the servovalve assembly 100. As such the manufacturer detects a discrepancy between the measured pressure output and the defined pressure output, thereby indicating inexact (e.g., non-null) positioning of the flapper 114 relative to the nozzles 118, 120, such as caused by manufacturing imprecision.

In step 206, the manufacturer adjusts an adjustment assembly 108 of the servovalve assembly 100 to generate a force on a shaft 112 of the servovalve assembly 100 to position a flapper 114 of the 112, relative to a first nozzle 118 and a second nozzle 120 of the servovalve assembly 100. The following describes positioning or activation of the adjustment assembly 108.

FIG. 7 illustrates user activation of the adjustment assembly 108 to adjust a position of the flapper 114 relative to the nozzles 118, 120. Assume that the spring wire 170, shaft 112, and flapper 114 orient in a first position 190 relative to the adjustment assembly 108. Further assume that a user must adjust a position the flapper 114 within the servovalve assembly 100 to move the flapper 114 toward the second nozzle 120 to adjust a pressure output of the servovalve assembly 100.

In one arrangement, a user inserts a tool, such as a screwdriver, into the base 150 such that the screwdriver orients between a first face 155-1 of the holder 155 and a first face 150-1 of the base 150 (i.e. clockwise rotation of the holder 155 relative to the base 150). The user applies a lateral, rotational force 164-1 to the holder 155 such that the holder 155 rotates about the fillets 163-1, 163-2 relative to the base 150 and base attachment portion 157. In response to application of the lateral force 164-1 to the holder 155, which creates a permanent (i.e. plastic) deformation on the holder 155, the spring wire 170 bends relative to the base 150, to orient in a second position 192-1 (i.e. relative to the first position 190 of the spring wire 170). Bending of the spring wire 170 adjusts a position of the control portion 172 relative to the base 150 and causes the control portion 172 to generate a substantially constant load or force on the shaft 112. The deformation causes the control portion 172 to adjust a lateral position of the shaft 112 within the motor assembly 104 of the servovalve assembly 100 such that the shaft 112 positions in a second position 192-2 relative to the second nozzle 120 (e.g., and relative to the first position 190 of the shaft 112). In response to the shaft 112 orienting in the second position 192-2, the flapper 114 orients in a second position 192-3 relative to the second nozzle 120 (e.g., and relative to the first position 190 of the flapper 114), thereby adjusting the pressure output of the servovalve assembly 100.

Returning to FIG. 6, and in conjunction with FIG. 7, after the manufacturer adjusts the adjustment assembly 108, the manufacturer, in one arrangement, repeats the steps of measuring, detecting, and adjusting until the measured pressure output or the servovalve assembly 100 is substantially equal to a defined pressure output. For example, by repeating the steps of measuring, detecting, and adjusting, the manufacturer iteratively orients the flapper 114 in a null position relative to the first nozzle 118 and the second nozzle 120 such that the measured pressure output or the servovalve assembly 100 is substantially equal to a defined pressure output.

While this invention has been particularly shown and described with references to preferred embodiments thereof, it will be understood by those skilled in the art that various changes in form and details may be made therein without departing from the spirit and scope of the invention as defined by the appended claims.

In one arrangement, as illustrated in FIG. 3, the adjustment assembly 108 defines a relatively low profile height 188, relative to an overall height of the servovalve assembly 100. For example, in one arrangement, the height 188 is approximately 0.140 inches (3.56 mm). Returning to FIG. 2, when the adjustment assembly 108 mounts to the top portion of the housing 102 of the servovalve assembly 100, the height 188 of the adjustment assembly 108 minimally affects an overall height of the servovalve assembly 100. With such a configuration of the adjustment assembly 108, an end-user can install the adjustment assembly 108 on existing nozzle-flapper servovalve assemblies while minimizing the necessity to increase the space required to house the existing servovalves in their current applications.

As indicated above, the adjustment assembly 108 is configured to generate a load or force on a shaft 112 of a servovalve assembly in order to position a flapper 114, coupled to the shaft 112, relative to a first nozzle 118 and a second nozzle 120 of the servovalve 100. Such description is by way of example only. In one arrangement, an adjustment device has a base, a control portion, and an arm portion that couples the base to the control portion. The arm portion is configured to, in response to a deformation of the arm portion, position the control portion relative to the base. In response to the deformation of the arm portion, the control portion positions a flapper of the shaft relative to a first nozzle and a second nozzle of the servovalve. Such adjustment orients the flapper in a null position relative to the nozzles and adjusts a pressure output of the servovalve assembly. By positioning the flapper relative to the nozzles, the adjustment device minimizes the necessity for the use of special tools to adjust the relative position of the nozzles relative to the flapper to adjust a pressure output of the servovalve assembly.

FIG. 7 illustrates user activation of the adjustment assembly 108 to adjust a position of the flapper 114 relative to the nozzles 118, 120 where the user adjusts a position the flapper 114 within the servovalve assembly 100 to move the flapper 114 toward the second nozzle 120 so adjust a pressure output of the servovalve assembly 100. Such description is by way of example only. In one arrangement, the user adjusts a position the flapper 114 within the servovalve assembly 100 to move the flapper 114 toward the first nozzle 118 to adjust a pressure output of the servovalve assembly 100.

In one arrangement, a user inserts a tool, such as a screwdriver, into the base 150 such that the screwdriver orients between a second face 155-2 of the holder 155 and a second face 150-2 of the base 150 (i.e. counterclockwise rotation of the holder 155 relative to the base 150). The user applies a lateral, rotational force 164-2 to the holder 155 such that the holder 155 rotates about the fillets 163-1, 163-2 relative to the base attachment portion 157 and base 150. In response to application of the lateral force 164-2, the spring wire 170 bends relative to the base 150, to orient in a second position 194-1 (i.e. relative to the first position 190 of the spring wire 170). Bending of the spring wire 170 adjusts a position of the control portion 172 relative to the base 150 and causes the control portion 172 to generate a substantially constant load or force on the shaft 112. The deformation causes the control portion 172 to adjust a lateral position of the shaft 112 within the motor assembly 104 of the servovalve assembly 100 such that the shaft 112 positions in a second position 194-2 relative to the first nozzle 118 (e.g., and relative to the first position 190 of the shaft 112). In response to the shaft 112 orienting in the second position 194-2, the flapper 114 orients in a second position 194-3 relative to the first nozzle 118 (e.g., and relative to the first position 190 of the flapper 114), thereby adjusting the pressure output of the servovalve assembly 100.

As described above, embodiments of the adjustment device or adjustment assembly 108 allow adjustment of a null offset position of a flapper 114 of a nozzle-flapper servovalve. Such description is by way of example only. In one arrangement, the adjustment device 108 adjusts the position of a jet-pipe in a jet-pipe servovalve. For example, the adjustment assembly 108 couples to a first end of a jet-pipe within a jet-pipe servovalve (i.e. the first end opposing a jet end of the jet-pipe). Positioning of the adjustment device 108 changes the position of the jet end relative to a first receiver and a second receiver and adjusts a null offset position of the jet pipe within the jet-pipe servovalve.

What is claimed is:

1. A servovalve assembly comprising:

a housing having a spool disposed within an opening defined by the housing;

a first nozzle in fluid communication with a first end of the spool;

a second nozzle in fluid communication with a second end of the spool;

a motor coupled to the housing, the motor having a flapper shaft and a flapper coupled to the flapper shaft, the flapper oriented in fluid communication with the first nozzle and the second nozzle; and an adjustment assembly having:

a base coupled to the housing;

a control portion coupled to the flapper shaft of the motor; and an arm portion that couples the base to the control portion, the arm portion configured to, in response to a deformation of the arm portion, position the control portion relative to the base, the control portion further configured to, in response to the deformation of the arm portion, generate a load on the flapper shaft and position the flapper of the flapper shaft relative to the first nozzle and the second nozzle of the servovalve;

wherein the control portion is configured to rotatably couple to the flapper shaft to allow rotation of the flapper shaft relative to the control portion;

wherein the control portion comprises a ball coupled to the arm portion, the ball configured to rotatably couple to an opening defined by the flapper shaft.

2. The servovalve assembly of claim 1 wherein the control portion, in response to the deformation of the arm portion, is configured to adjust a null position of the flapper relative to the first nozzle and the second nozzle of the servovalve such that a first gap defined by the first nozzle and the flapper is substantially equal to a second gap defined by the second nozzle and the flapper.

3. The servovalve assembly of claim 1 wherein the arm portion comprises a spring wire that couples the base to the control portion, the spring wire configured to, in response to a bending of the spring wire, position the control portion relative to the base to generate a spring force on the flapper shaft to position the flapper relative to the first nozzle and the second nozzle.

4. The servovalve assembly of claim 3 wherein the spring wire comprises a cold worked surface.

5. The servovalve assembly of claim 1 wherein the base comprises a holder coupled to the first end of the arm portion, the holder defining at least one fillet configured to allow rotation of the arm portion relative to the base in response to a deformation.

6. The servovalve assembly of claim 1, wherein:

the arm portion extends from the base to the control portion within a plane; and the arm portion configured to, in response to a deformation of the arm portion disposed in proximity to the base, the deformation occurring along a first lateral direction and substantially within the plane, position the control portion along a second lateral direction relative to the base, the second lateral direction substantially opposing the first lateral direction.

* * * * *